US008059060B2

(12) United States Patent
Barter et al.

(10) Patent No.: US 8,059,060 B2
(45) Date of Patent: Nov. 15, 2011

(54) UNITARY SOLDERLESS MONOPOLE ANTENNA FOR IN-DUCT USE

(75) Inventors: Paul Barter, Deerfield, IL (US); Rudy Ruelas, Orland Hills, IL (US)

(73) Assignee: I-5 Wireless, LLC., Lisle, IL (US)

( * ) Notice: Subject to any disclaimer, the term of this patent is extended or adjusted under 35 U.S.C. 154(b) by 299 days.

(21) Appl. No.: 12/334,948

(22) Filed: Dec. 15, 2008

(65) Prior Publication Data

US 2010/0060545 A1 Mar. 11, 2010

Related U.S. Application Data

(60) Provisional application No. 61/095,135, filed on Sep. 8, 2008.

(51) Int. Cl.
*H01Q 1/12* (2006.01)

(52) U.S. Cl. ..... 343/878

(58) Field of Classification Search ..... 343/878, 343/866, 895, 702, 873
See application file for complete search history.

(56) References Cited

U.S. PATENT DOCUMENTS

| | | | | |
|---|---|---|---|---|
| 5,661,495 | A * | 8/1997 | Saldell | 343/702 |
| 5,945,953 | A * | 8/1999 | Tsuda et al. | 343/702 |
| 5,952,974 | A * | 9/1999 | Ito et al. | 343/702 |
| 5,995,064 | A * | 11/1999 | Yanagisawa et al. | 343/895 |
| 6,034,639 | A * | 3/2000 | Rawlins et al. | 343/702 |
| 6,271,804 | B1 * | 8/2001 | Yanagisawa et al. | 343/895 |
| 2007/0210967 | A1 * | 9/2007 | Aminzadeh et al. | 343/7 MS |

* cited by examiner

*Primary Examiner* — Huedung Mancuso
(74) *Attorney, Agent, or Firm* — McDonnell Boehnen Hulbert & Berghoff

(57) ABSTRACT

An improved monopole antenna for in-duct use is disclosed. The antenna comprises a center pin rod disposed coupled to a connector housing by a molded dielectric. The center pin rod includes a pin portion which is disposed through a portion of a connector portion of the connector housing, thereby allowing a mating RF connector to couple to the monopole antenna. The center pin rod is composed of a single assembly or a single piece of material, thereby eliminating the need to solder the antenna to a RF connector.

18 Claims, 6 Drawing Sheets

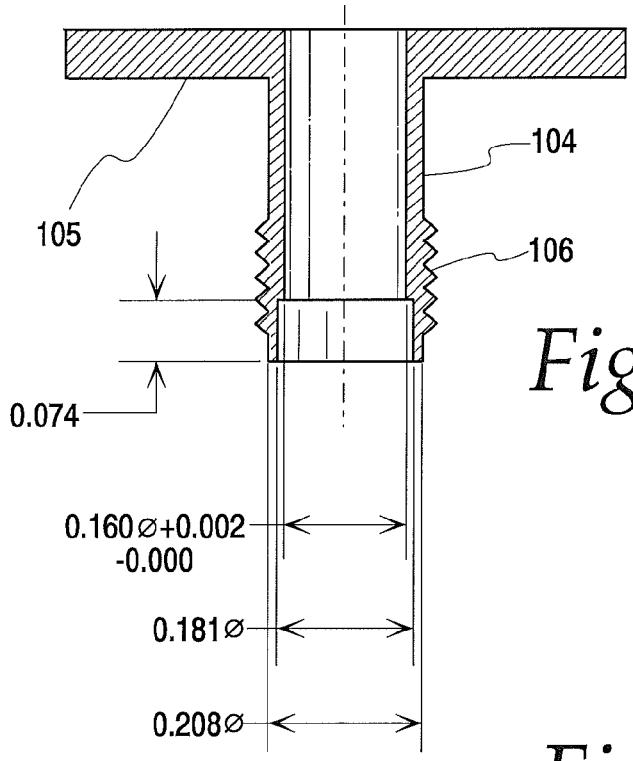
Fig. 11
Fig. 12
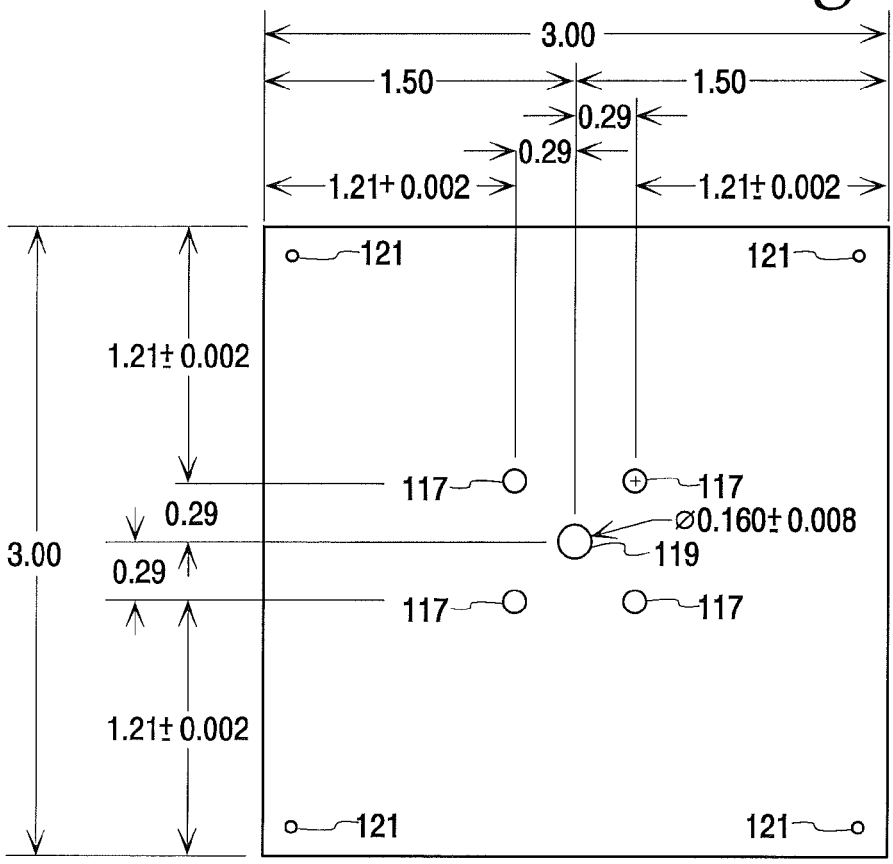

UNITARY SOLDERLESS MONOPOLE ANTENNA FOR IN-DUCT USE

CROSS-REFERENCE TO RELATED APPLICATIONS

This application claims priority under 35 U.S.C. §119(e) from U.S. Provisional Patent Application Number 61/095,135, entitled "UNITARY SOLDERLESS MONOPOLE ANTENNA FOR IN-DUCT USE," filed on behalf of inventors Paul Barter and Rudy Ruelas on Sep. 8, 2008.

FIELD OF THE INVENTION

The present invention relates generally to antenna, and more particularly to antenna for use within the duct system of a building, and more particularly still to a monopole antenna for use within the duct system of a building.

DESCRIPTION OF THE PRIOR ART

A monopole antenna is a type of simple radio antenna formed by replacing a portion of a dipole antenna with a ground plane at a right-angle to the remaining portion. If the ground plane is sufficiently large, a monopole antenna will behave similarly to a comparable dipole antenna. The use of monopole antennas and their characteristics are well known in the art. For example, many radio broadcast antennas are monopole antennas. Similarly, whip antennas, widely used in handheld radios, are also monopole antennas.

FIG. 1 discloses a monopole antenna that was used within the heating, cooling, and ventilation duct system of a building ("in-duct") for reception and transmission of radio signals. As can be seen, the prior art monopole antenna was coupled to the duct through the use of a clip mechanism that engaged the interior of the duct through a hole that was cut into the exterior of the duct. The antenna also included a conductive rod formed such that it was one-quarter wavelength of the desired frequency that the monopole antenna was designed to receive and transmit. The rod was joined to a SMA connector by a solder dot. While the prior art in-duct monopole antenna was operable, there are a number of shortcomings that it does not address. First, the prior art antenna was expensive to manufacture, in that it required hand-soldering of the SMA connector to the rod and the solder caused an unpredictable voltage standing wave ratio. Second, the prior art antenna was difficult to install, as it required a precise hole to be cut in the exterior of the duct, so that the clip mechanism could properly engage the duct and hold the antenna in place. Third, improper formation of the mounting hole could cause moisture, which tends to accumulate within ducts, to leak out of the duct. Fourth, the ground plane was too thick to be bent and reliably connect to a round duct. Fifth the ground plane was not permanently mounted and easily dislodged from the duct.

OBJECTS OF THE INVENTION

Accordingly, it is an object of this invention to provide an improved monopole antenna for use within the duct system of a building.

Another object of the invention is to provide an in-duct monopole antenna that is inexpensive to manufacture;

Another object of the invention is to provide an in-duct monopole antenna that is simple to install;

Another object of the invention is to provide an in-duct monopole antenna that does not create leaks from the duct system;

Other advantages of the disclosed invention will be clear to a person of ordinary skill in the art. It should be understood, however, that a system, method, or apparatus could practice the disclosed invention while not achieving all of the enumerated advantages, and that the protected invention is defined by the claims.

SUMMARY OF THE INVENTION

The disclosed invention achieves its objectives by providing a monopole antenna adapted for in-duct use comprising a connector housing for mounting to a flat bendable metal surface through one or more screw holes. The connector housing comprises a flat, bendable portion including the screw holes and a connector portion having a hollow interior. The connector portion may comprise a series of threads adapted to couple with a reverse polarity female SMA, N or other size or threaded coaxial connector, or may be adapted to couple with some other form of RF connector. The monopole antenna further comprises a center pin rod including an antenna portion, a mounting portion, and a pin portion. The antenna portion is generally sized to transmit and receive a particular desired wavelength corresponding to the type of signal with which the monopole antenna will be used. The pin portion is disposed so that it will comprise the center conductor of the connector formed with the connector portion of the connector housing. A molded dielectric, such as a fluoropolymer resin, is formed about the mounting portion of the center pin rod and a portion of the connector portion of the connector housing. A sufficient length of the pin portion of the center pin rod is exposed to mate with a corresponding RF connector. The center pin rod is formed of a single piece of material, or is a single assembled component, thereby eliminating the step of soldering the antenna portion to an RF connector.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof wherein like reference numerals refer to like parts throughout the several views and in which:

FIG. 11 is an exploded side view of the connector portion depicted by FIG. 8; and FIG. 12 is a bottom view of a mounting plate used in conjunction with the improved monopole antenna of FIG. 2.

DETAILED DESCRIPTION OF THE ILLUSTRATED EMBODIMENT

Figure 1:
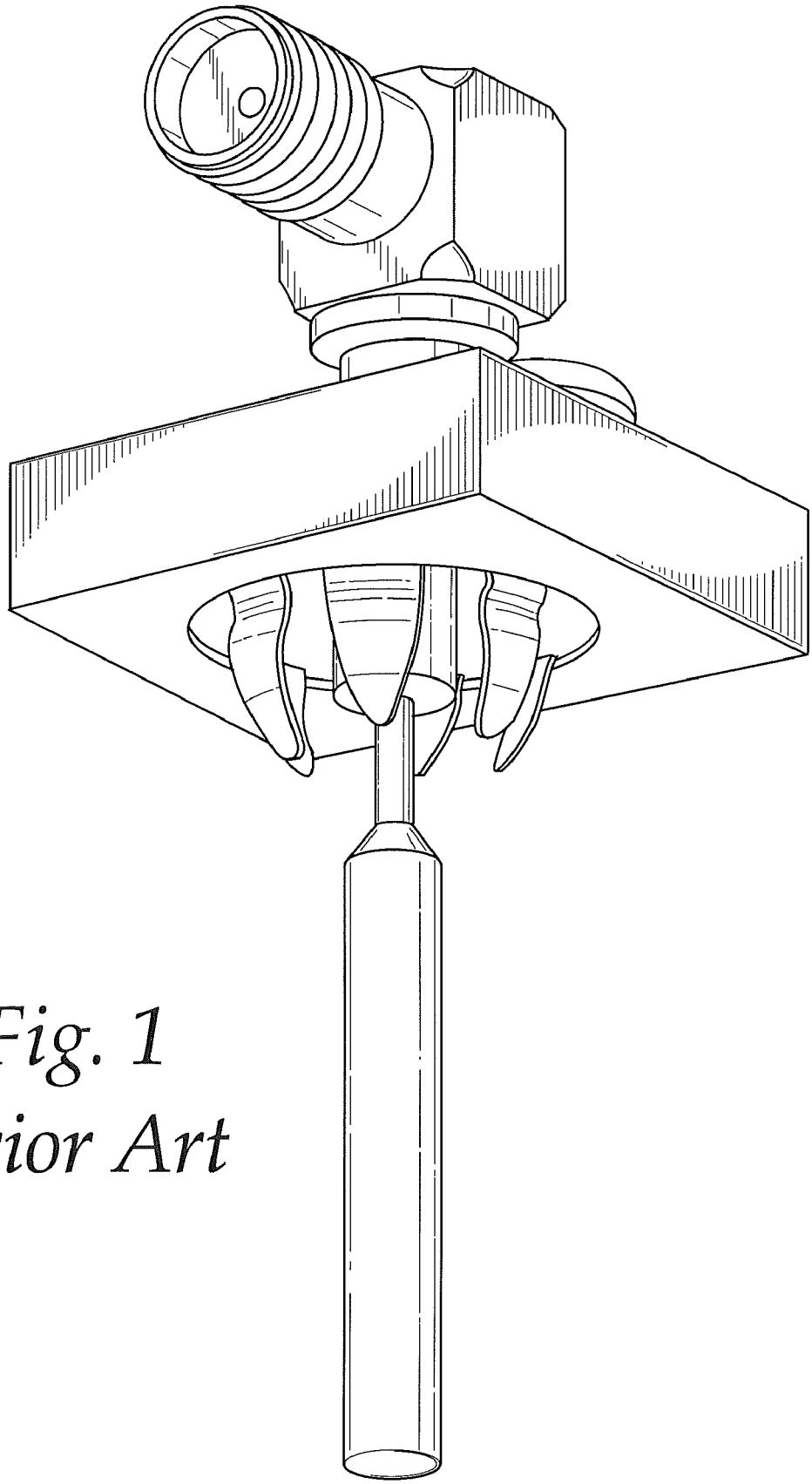
Fig. 1 Prior Art
FIG. 1 is a perspective view of a prior art antenna used for in-duct reception and transmission of radio signals.
Figure 2:
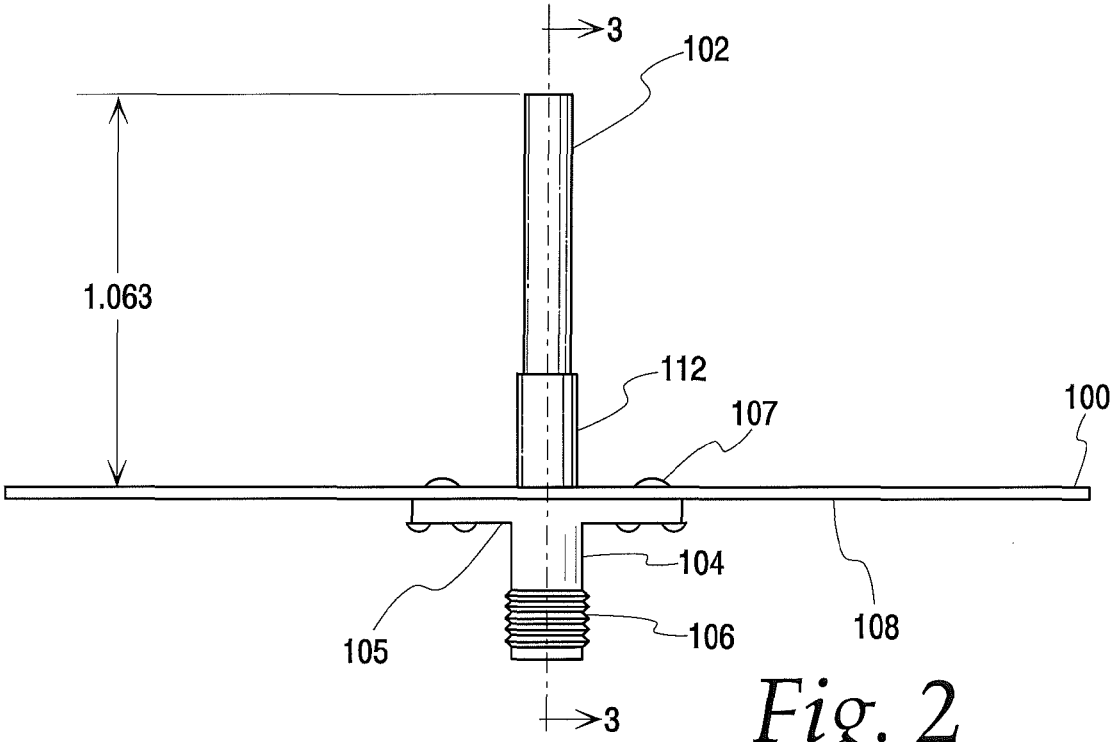
FIG. 2 is a side view of an improved monopole antenna for in-duct reception and transmission of radio signals.

Turning to the Figures, and to FIG. 2 in particular, a monopole antenna 100 constructed in accordance with the disclosed invention is depicted. The depicted monopole antenna 100 comprises a center pin rod 102 formed with a length adapted to be one-quarter of the wavelength of the signal the monopole antenna 100 is intended to transmit and receive. The center pin rod 102 is formed of a non-combustible and corrosion resistant material, such as gold plated brass. The center pin rod 102 is coupled to an injection molded fluoropolymer resin dielectric 112. The low-smoke producing fluoropolymer resin dielectric 112 provides spacing between the center pin rod 102 and a flat, bendable mounting plate 108. The flat, bendable mounting plate 108 is coupled to a connector housing 104 by a series of screws 107. The connector housing 104 is formed as a single piece including a flat bendable portion 105 and a connector portion 106. The connector housing is formed of 18-24 gauge galvanized steel. The connector portion may be formed to accept, for example, a reverse polarity SMA (SubMiniature version A) socket. The connector housing may be formed of gold plated brass, or some other appropriate material.

As explained herein, the monopole antenna 100 is installed into a duct system by drilling a small hole sized to accept the center pin rod 102, inserting the center pin rod 102 through the hole, and screwing the flat, bendable mounting plate 108 to the duct. Caulk may be used to seal the hole through which the center pin rod 102 is inserted.

Figure 3:
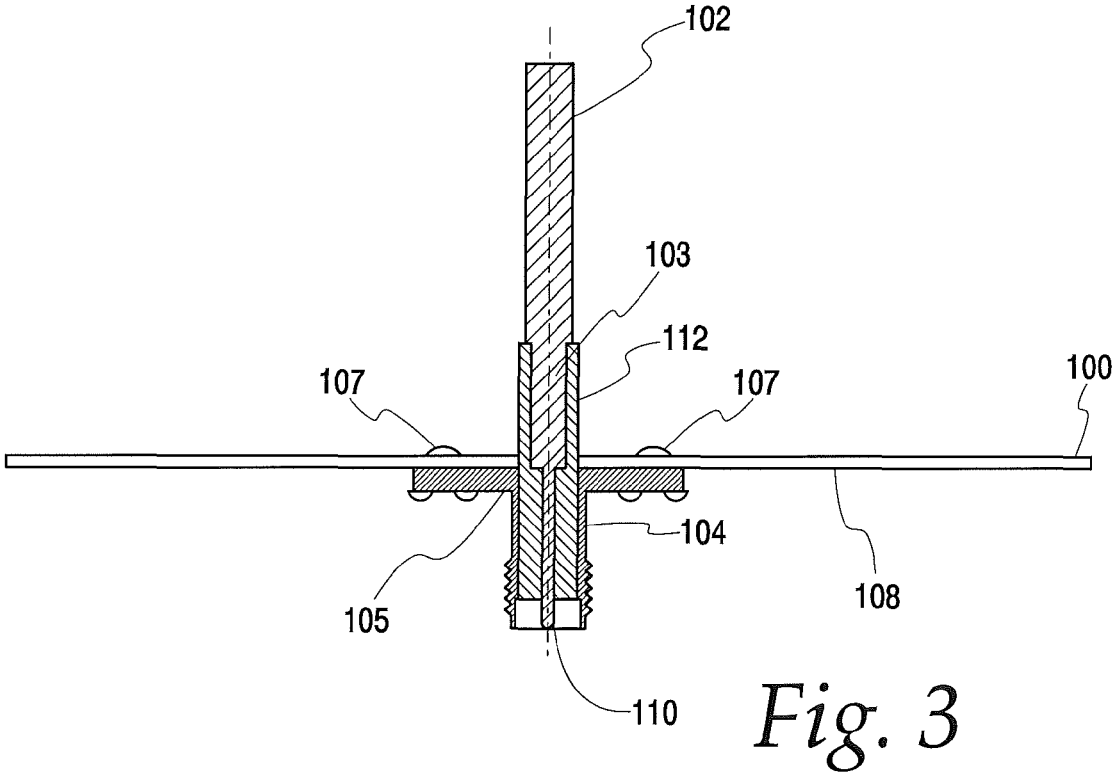
FIG. 3 is an exploded side view of the improved monopole antenna of FIG. 2.

FIG. 3 depicts an exploded side view of the disclosed improved monopole antenna 100. The center pin rod 102 actually comprises three portions; an upper antenna portion 111, a center mounting portion 103, and a lower pin portion 110. By forming the center pin rod 102 of a single piece of material or component with three separate portions, the step of soldering the center pin rod 102 to an SMA connector is eliminated. FIG. 3 also shows how the injection molded fluoropolymer resin dielectric 112 is formed about the mounting portion 103 of the center pin rod 102 through most of the connector portion 106 of the connector housing 104, leaving only a small amount of the lower pin portion 110 exposed for coupling with an SMA socket.

Figure 4:
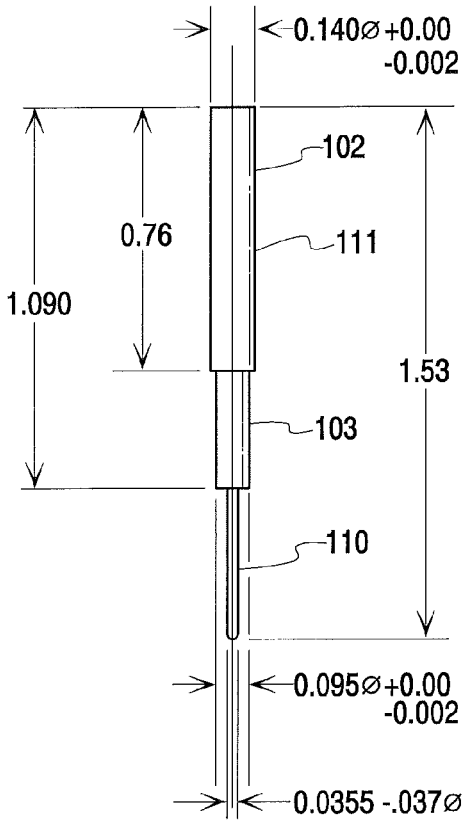
FIG. 4 is a side view of the rod/center conductor component used by the improved monopole antenna of FIG. 2.

FIG. 4 most clearly depicts the construction of the center pin rod 102 used in the disclosed improved monopole antenna. While the center pin rod 102 is formed of a single piece of material, such as gold plated brass or simply brass, it comprises three separate portions. The antenna portion 111 is sized to be one-quarter the wavelength of the signal which the monopole antenna will transmit and receive. The mounting portion 103 is narrower than the antenna portion 102 to allow the acceptance of an injection molded dielectric, such as a fluoropolymer resin. The pin portion 110 is sized to mate with a female reverse polarity SMA socket or other RF connector, and sufficiently long to extend through the injection molded dielectric and couple with the aforementioned socket.

Figure 5:
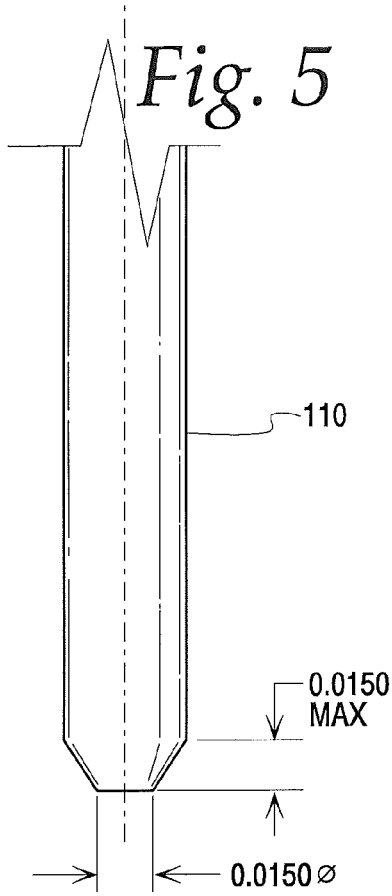
FIG. 5 is an exploded side view of the center conductor portion of the rod/center conductor component depicted by 4.

FIG. 5 depicts the dimensions of the tip of the pin portion 110 of the center pin rod used in the disclosed improved monopole antenna.

Figure 6:
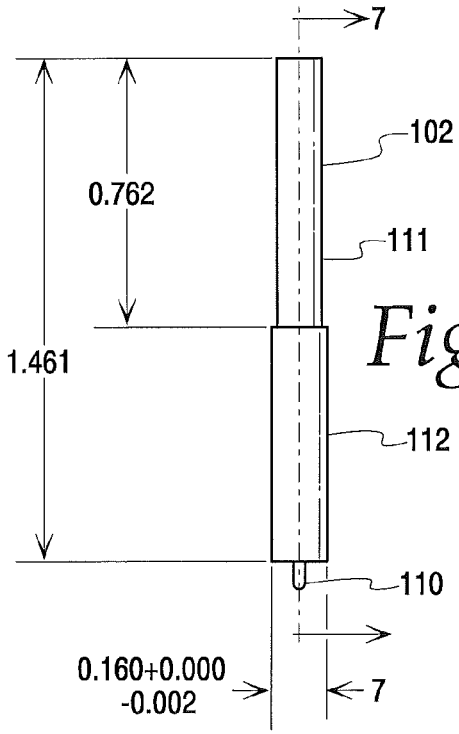
FIG. 6 is a side view of the rod/center conductor component after a fluoropolymer resin dielectric has been injection molded about the narrow portion of the rod.

FIG. 6 depicts the center pin rod 102 encapsulated by the injection molded dielectric 112.

Figure 7:
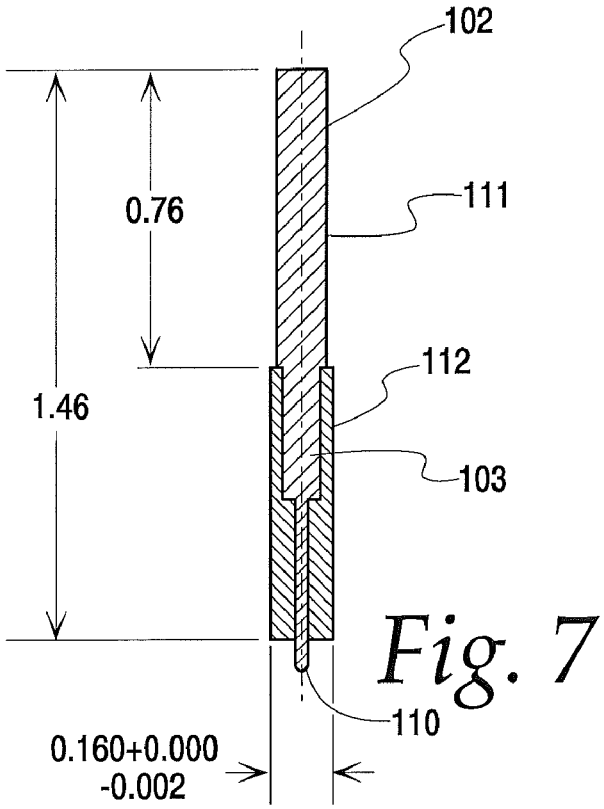
FIG. 7 is an exploded side view of the assembly of 6.

FIG. 7 depicts an exploded view of the center pin rod 102 encapsulated by the injection molded dielectric 112. As shown, the dielectric 112 surrounds the mounting portion 103 of the center pin rod 102, as well as part of the pin portion 110.

Figure 8:
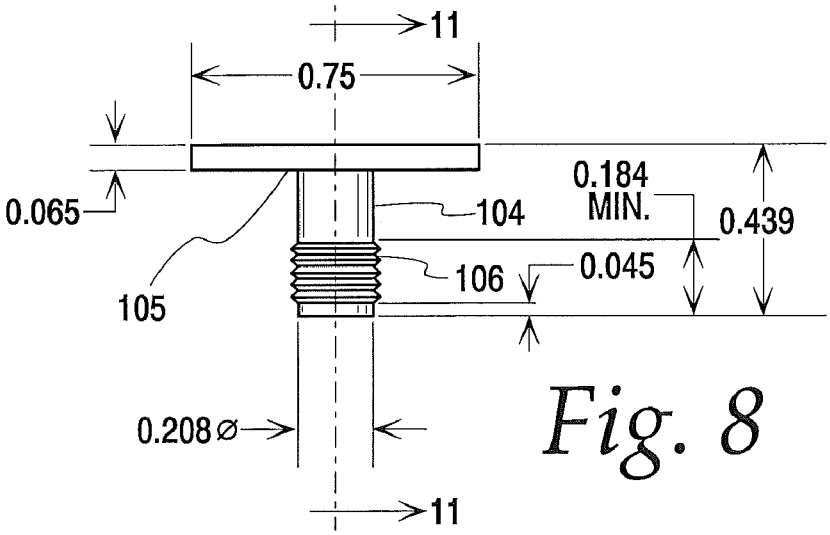
FIG. 8 is a side view of the connector portion of the improved monopole antenna of FIG. 2.

FIG. 8 depicts the connector housing 104 used with the disclosed improved monopole antenna. As illustrated, the connector housing 104 is comprised of a single piece of material. The material may be, for example, 18-24 gauge galvanized steel, or gold plated brass. The connector housing 104 includes a flat but bendable portion 105 and a connector portion 106. The connector portion 106 may include a series of threads to accept a mating connector, such as, for example, a reverse polarity SMA socket.

Figure 9:
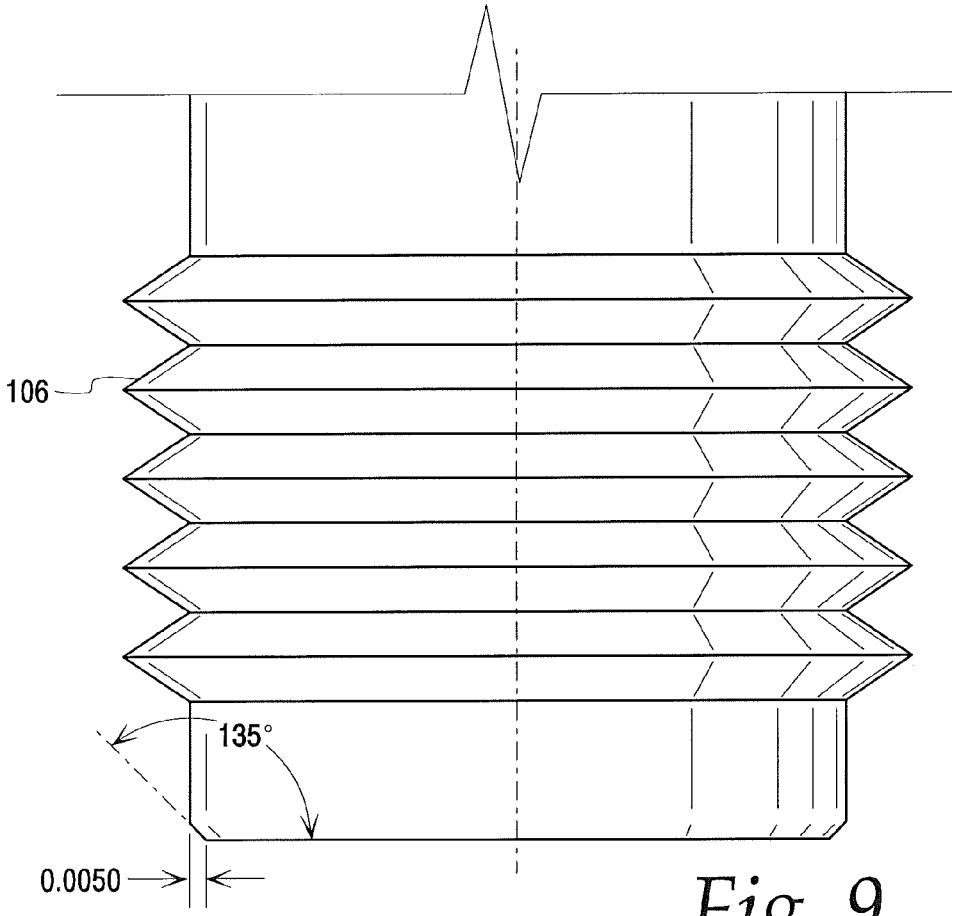
FIG. 9 is a side view of an SMA connector used by the connector portion depicted by FIG. 8.

FIG. 9 depicts one possible set of dimensions of the connector portion 106 of the connector housing 104 depicted in FIG. 8.

Figure 10:
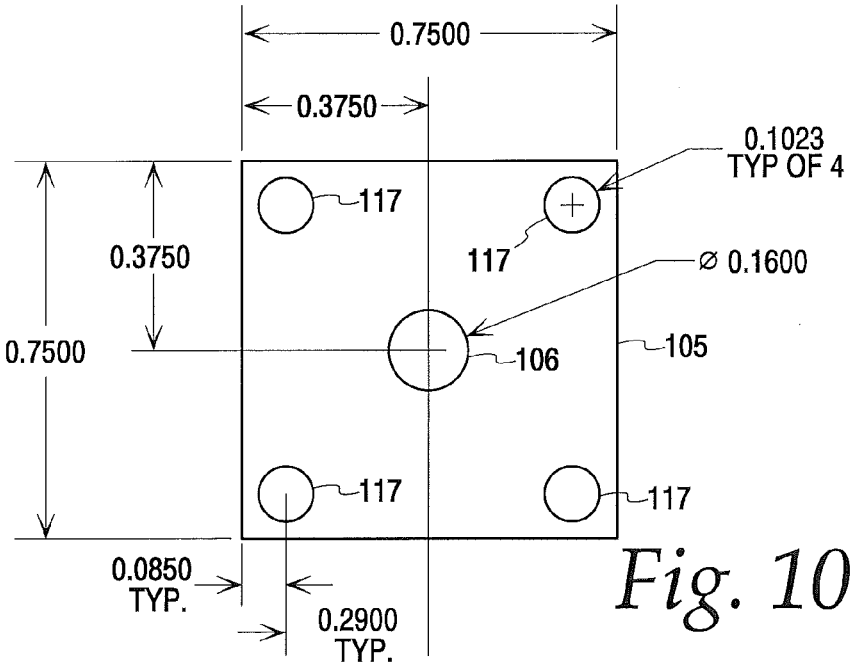
FIG. 10 is a bottom view of the connector portion depicted by FIG. 8.

FIG. 10 depicts one possible set of dimensions of the flat portion 105 of the connector housing 104 depicted in FIG. 8. As illustrated, the flat portion 105 is mounted to the flat, bendable mounting plate (not show in 10) by a series of four screws using the screw holes 117.

FIG. 11 depicts an exploded side view of the connector housing 104, showing one possible set of dimensions for various portions.

FIG. 12 depicts the flat, bendable mounting plate 108 used for mounting the disclosed monopole antenna to a duct system. The flat, bendable mounting plate 108 includes a center hole 119 sized to accept the center pin rod of the monopole antenna. In addition, a series of screw holes 117 is used to connect the flat, bendable mounting plate 108 to the connector housing. Further, a second series of screw holes 121 is used to connect the flat, bendable mounting plate to a duct system.

The foregoing description of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specifications but be defined by the claims set forth below.

What is claimed is:

1. A monopole antenna for in-duct transmission and reception of a signal, said monopole comprising:

i) a connector housing including a flat portion adapted to mount to a metal surface and a connector portion having a hollow interior;

ii) a center pin rod having an antenna portion adapted to transmit and receive said signal, said center pin rod further having a center mounting portion, and a pin portion at least partially disposed within said connector portion of said connector housing; and iii) a dielectric securely attached to said mounting portion of said center pin rod and extending at least partially within the hollow interior of said connector portion of said connector housing.

2. The monopole antenna of claim 1, further comprising a mounting plate disposed so that said connector housing is coupled to a first side of said mounting plate and said center pin rod extends from a second side of said mounting plate.

3. The monopole antenna of claim 2, wherein said mounting plate comprises four mounting holes disposed about a periphery of said mounting plate.

4. The monopole antenna of claim 3, wherein said mounting holes are each adapted to accept a screw and further adapted to couple said mounting plate to the exterior of a duct system using said screws.

5. The monopole antenna of claim 1, wherein said center pin rod is comprised of brass.

6. The monopole antenna of claim 1, wherein said center pin rod is comprised of gold plated brass.

7. The monopole antenna of claim 1, wherein said dielectric is comprised of fluoropolymer resin.

8. The monopole antenna of claim 1, wherein said connector portion further comprises a series of threads adapted to couple with an SMA connector.

9. The monopole antenna of claim 1, wherein the antenna portion has a first diameter, the mounting portion has a second diameter, and the pin portion has a third diameter, wherein the first diameter is greater than the second diameter and the third diameter, and the second diameter is great than the third diameter.

10. The monopole antenna of claim 1, wherein the antenna portion, mounting portion, and pin portion are integral and comprise a single component.

11. The monopole antenna of claim 1, wherein the dielectric is molded around the mounting portion.

12. The monopole antenna of claim 11, wherein the dielectric is molded around at least a portion of the pin portion.

13. The monopole antenna of claim 1, wherein the flat portion of the connector housing is bendable.

14. The monopole antenna of claim 2, wherein the mounting plate is bendable.

15. The monopole antenna of claim 1, wherein the flat portion of the connector housing is adapted for connection to a duct, and the antenna portion is adapted to be positioned within the duct.

16. The monopole antenna of claim 12, wherein an end of the pin portion extends beyond the dielectric.

17. The monopole antenna of claim 8, wherein an end of the pin portion is adapted for coupling with an SMA connector.

18. The monopole antenna of claim 2, wherein the mounting plate is bendable, and the flat portion of the connector housing is bendable to allow for connection to a duct.

* * * * *